US006330797B1

(12) United States Patent
Kondo

(10) Patent No.: US 6,330,797 B1
(45) Date of Patent: Dec. 18, 2001

(54) HYDRAULIC CIRCUIT FOR TURNING EXCAVATOR

(75) Inventor: Masami Kondo, Osaka (JP)

(73) Assignee: Yanmar Diesel Engine Co., Ltd., Osaka (JP)

( * ) Notice: Subject to any disclaimer, the term of this patent is extended or adjusted under 35 U.S.C. 154(b) by 0 days.

(21) Appl. No.: 09/254,514

(22) PCT Filed: Sep. 18, 1997

(86) PCT No.: PCT/JP97/03288

§ 371 Date: Mar. 4, 1999

§ 102(e) Date: Mar. 4, 1999

(87) PCT Pub. No.: WO98/12391

PCT Pub. Date: Mar. 26, 1998

(30) Foreign Application Priority Data

Sep. 19, 1996 (JP) ..... 8-247883

(51) Int. Cl.[7] ..... F16D 31/02
(52) U.S. Cl. ..... 60/421; 60/486
(58) Field of Search ..... 60/421, 422, 428, 60/429, 486

(56) References Cited

U.S. PATENT DOCUMENTS 3,686,862 * 8/1972 Grider et al. ..... 60/445
3,723,026 * 3/1973 Soyland et al. ..... 417/286
3,922,855 * 12/1975 Bridwell et al. ..... 60/421
3,998,053 * 12/1976 Johnson ..... 60/422
4,000,616 * 1/1977 Symmank ..... 60/420
4,210,061 * 7/1980 Bianchetta ..... 60/486 X
4,526,085 * 7/1985 Morizur et al. ..... 91/6
4,649,705 * 3/1987 Williamson ..... 60/420
4,928,488 * 5/1990 Hunger ..... 60/486 X
4,961,371 * 10/1990 Takashima ..... 91/530
4,986,075 * 1/1991 Shimoie ..... 60/468
5,136,846 * 8/1992 Arii et al. ..... 60/468
5,832,729 * 11/1998 Reid et al. ..... 60/421

* cited by examiner

*Primary Examiner*—John E. Ryznic
(74) *Attorney, Agent, or Firm*—Sterne, Kessler, Goldstein & Fox P.L.L.C.

(57) ABSTRACT

A hydraulic circuit which, when applied to a turning excavator having hydraulic actuators for the working arms and the turning excavator body supplied with pressure oil from three pumps, can increase the operation speed of the booms and arms without providing a separate hydraulic pump to improve the work efficiency. During the individual driving, the boom cylinder (CY1) is supplied with a pressure oil from the first and third pumps (P1, P3), the arm cylinder (CY2) from the second and third pumps (P2, P3), the bucket cylinder (CY3) from the first pump (P1), and the turning motor (M) from the third pump (P3). During the simultaneous driving of the boom and arm cylinders (CY1, CY2), the arm is supplied with an operation speed increasing pressure oil from the third pump (P3). When the boom cylinder (CY1) and the turning motor (M) are simultaneously operated, a part of the pressure oil to the turning motor (M) from the third pump (P3) is supplied to the boom cylinder (CY2).

8 Claims, 4 Drawing Sheets

HYDRAULIC CIRCUIT FOR TURNING EXCAVATOR

SPECIFICATION

1. Field of the Art

The present invention r elates to a hydraulic circuit system having at least three hydraulic pumps for supplying hydraulic actuators of a turning excavator with pressure oil, wherein working arms consisting of a boom, an arm and a bucket are operated and a turning excavator body is turned by the respective hydraulic actuators.

2. Background Art

Conventionally, it is a well-known technique for a turning excavator having a turning excavator body (a main body) and working arms consisting of a boom, an arm and a bucket to provide the hydraulic circuit system thereof with three hydraulic pumps for supplying hydraulic actuators for respectively driving the boom, the arm, the bucket and the main body with pressure oil, wherein each actuator is supplied with pressure oil by one of the pumps whether the actuators are driven one by one at different times (individually) or more than one of those are driven simultaneously.

For increasing the operation speed of each of the working arms like the boom, Japanese Laid Open Gazette No. Hei 8-134960 discloses a conventional turning excavator provided with a purpose-built hydraulic circuit having a hydraulic pump for it, wherein the circuit can be joined with chosen one of hydraulic circuits for the respective hydraulic actuators like a boom cylinder. Furthermore, Japanese Laid Open Gazette No. Hei 8-113961 discloses a joining circuit including a check valve interposed between a hydraulic circuit for turning the main body and a hydraulic circuit for driving the boom, thereby making the erecting operation of the boom faster than the turning operation of the main body when they are driven simultaneously.

Especially in various operations of the boom, the arm and the bucket of the working arms for excavation, the erecting operation of the boom and the pulling operation of the arm are hoped to be as swift as possible. However, with respect to the conventional hydraulic system, each hydraulic actuator is supplied with pressure oil from a single hydraulic pump, thereby being too low in quantity of pressure oil to be operated at such a hopeful speed. The hydraulic circuit system disclosed in Japanese Laid Open Gazette No. Hei 8-134960 is further provided with such purpose-built circuit for increasing the operation speed, thereby being complicated and expensive. Moreover, the check valve in the joining circuit cannot limit the amount of joined oil flow for restricting the increasing of the operation speed.

In some working conditions, more than one of the main body and the working arms are driven simultaneously. For example, a horizontal motion of the bucket for horizontal excavation requires the simultaneous erecting operation of the boom and pulling operation of the arm. In this case, making the pulling operation of the arm faster than the erecting operation of the boom is effective. However, there is no conventional hydraulic circuit system designed with said case in mind so as to give the arm priority over the boom when the both are operated simultaneously.

Supposing the turning excavator raises sand and moves it to a truck, the erecting operation of the boom must be prior to the turning of the main body. The above said conventional hydraulic circuit system of Japanese Laid Open Gazette No. Hei 8-113961 is designed with this situation in mind.

However, one of the three hydraulic pumps thereof is for pilot operation, so that each actuator is substantially supplied with pressure oil from either of only the other two pumps. Also, supposing a small excavator employs this hydraulic circuit system, the hydraulic pressure for turning operation of the main body is to be limited low. However, as the pressure oil for turning the main body flows into the hydraulic circuit for driving the boom, the boom may be moved too fast. The operation speed of the boom cannot be limited because the oil flowing from the above said joining circuit to the hydraulic circuit for the hydraulic actuator for the boom cannot be shut off.

SUMMARY OF THE INVENTION

A hydraulic circuit for a turning excavator according to the present invention is provided with first, second and third hydraulic pumps for supplying pressure oil to respective hydraulic actuators for driving a boom, an arm, a bucket and a turning main body of the turning excavator.

During the individual driving of them, an actuator for the boom is supplied with pressure oil from the first and third pumps, an actuator for the arm from the second and third pumps, an actuator for the bucket from the first pump, and an actuator for the main body from the third pump.

For simultaneously driving the boom and the arm, the third pump supply pressure oil to the actuator for the arm prior over that for the boom.

During the simultaneous driving of the boom and the arm, the hydraulic circuit, which makes the above mentioned pressure oil supplying patterns by the first, second and third hydraulic pumps thereof, preferentially supplies the actuator for the arm with pressure oil from the third pump. When the boom and the main body are operated simultaneously, it additionally supplies the actuator for the boom with a part of the pressure oil to the actuator for the main body from the third pump through a branching circuit.

The branching circuit toward the actuator for the boom may be a bleed-off-circuit.

Additionally, the pressure oil from the third pump to the actuator for the arm is partly bled off.

BEST MODE FOR PRACTICING THE INVENTION

Figure 1:
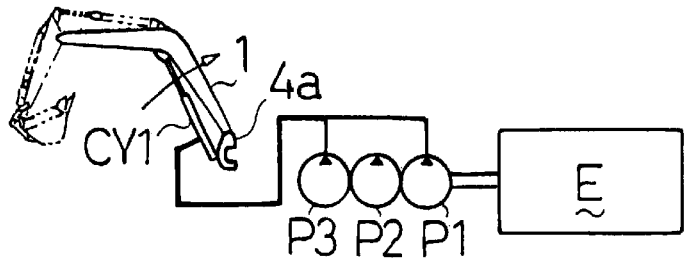
FIG. 1 is a diagram showing a pressure oil supplying pattern in a turning excavator having a three pump type hydraulic circuit system according to the present invention, during the individual driving of a boom.

At first, explanation will be given on a general construction of a turning excavator of the present invention. As shown in FIGS. 1 through 8, a main body 4 is rotatably mounted over a crawler type travelling device 5. A boom 1 is pivoted at the basic end thereof onto the front end of the main body 4. An arm 2 is pivoted at the basic end thereof onto the utmost end of the boom 1. A bucket 3 is pivoted at the basic end thereof onto the utmost end of the arm 2. The boom 1, arm 2 and bucket 3, serving as working arms, are driven by hydraulic actuators of a boom cylinder CY1, an arm cylinder CY2 and a bucket cylinder CY3, respectively. The main body 4 is turned about the travelling device 5 by a turning motor M serving as a hydraulic actuator.

Figure 4:
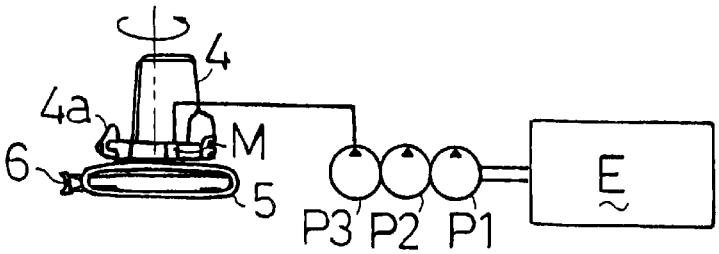
FIG. 4 is a similar diagram during the individual driving of a turning main body.
Figure 10:
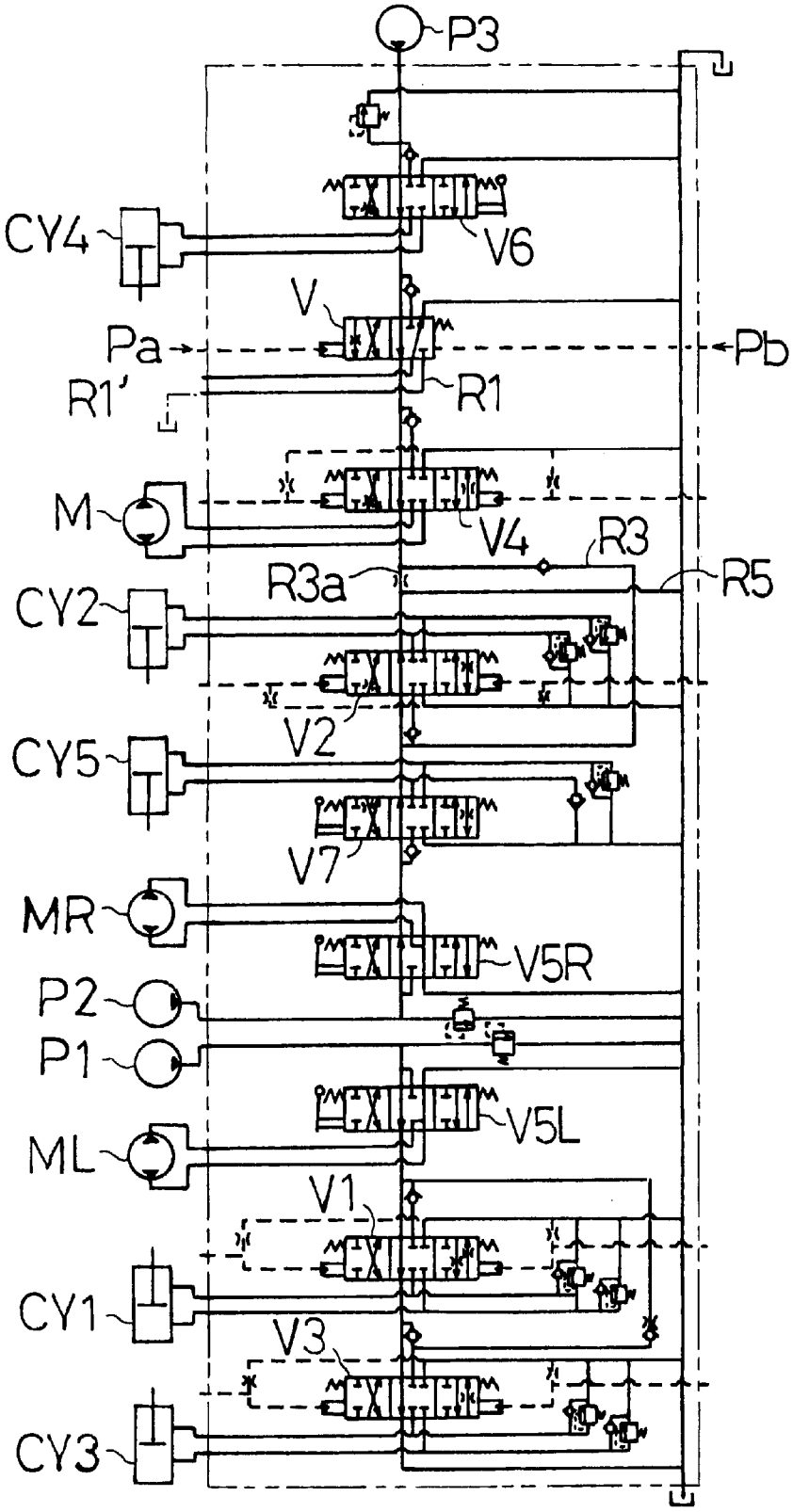
FIG. 10 is the same hydraulic circuit diagram, wherein a boom accelerating circuit shown in FIG. 9 can bleed off and an arm accelerating circuit shown in the same bleeds off a part of the pressure oil flowing therethrough.

In addition to the above mentioned hydraulic driving means, the travelling device 5 is provided with left and right hydraulic travelling motors ML and MR, which can be driven independently to each other. As shown in FIG. 4 or others, a blade 6 is provided on the travelling device 5. The blade 6 is vertically moved by a hydraulic cylinder CY4. A boom bracket 4a, which is disposed on the front end of the main body 4 for pivoting the basic end of the boom 1, is laterally rotated by a hydraulic swinging cylinder CY5 connected to the bottom of the main body 4. The boom 1 or arm 2 is provided with an oil extracting portion for PTO, to which a separate hydraulic driving means can be attached. The hydraulic motors ML and MR and cylinders CY4 and CY5 are shown in FIG. 10.

Figure 2:
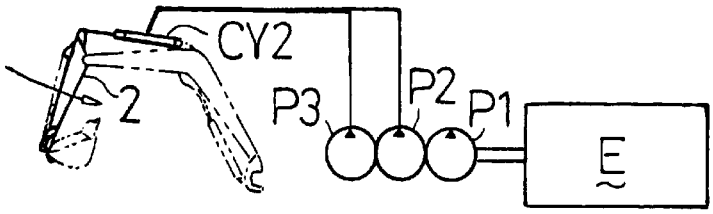
FIG. 2 is a similar diagram during the individual driving of an arm.
Figure 3:
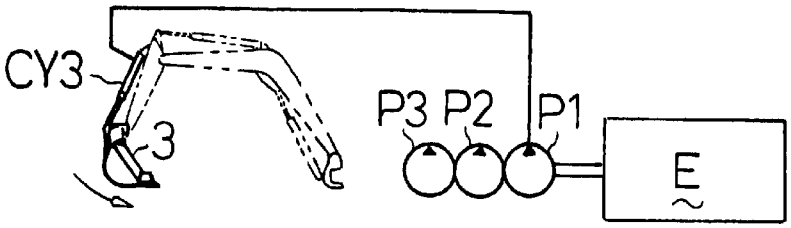
FIG. 3 is a similar diagram during the individual driving of a bucket.

Next, explanation will be given on a series of pressure oil supplying patterns made by a three pump type hydraulic circuit system in the turning excavator of the present invention having the above various hydraulic driving means in accordance with FIGS. 1 through 8. At first, the hydraulic circuit system is basically provided with main a first hydraulic main pump P1 and a second hydraulic main pump (a second pump) P2 , and a hydraulic sub pump (a third pump) P3, occasionally more than one. The first, second and third pumps P1, P2 and P3 are driven by an engine E. Fundamentally, the first pump P1 is connected to the boom and bucket cylinders CY1 and CY3, the second pump P2 to the arm cylinder CY2, and the third pump P3 to the turning motor M, through respective hydraulic circuits for supplying the hydraulic actuators with pressure oil. During the individual driving of the bucket 3 or the individual turning of the main body 4, only the first or third pump P1 or P3 supplies pressure oil as shown in FIGS. 3 and 4.

Additionally, joining circuits are extended from the third pump P3 to the boom cylinder CY1 and the arm cylinder CY2, respectively. During the individual operation of the boom cylinder CY1, the pressure oil from the third pump P3 joins that from the first pump P1 as shown in FIG. 1, thereby supplying the boom cylinder CY1 with the joined increased pressure oil, thereby enabling the erecting motion of the boom 1 to be accelerated. During the individual operation of the arm cylinder CY2, the pressure oil from the third pump P3 joins that from the second pump P2 as shown in FIG. 2, so that the arm cylinder CY2 is supplied with the joined increased pressure oil, thereby moving the arm 2 swiftly. Thus, the third pump 3 supply pressure oil for acceleration of the boom 1 and the arm 2 unless it is not used for turning the main body 4. The boom 1 and the arm 2 can be accelerated by such simple and low costing hydraulic circuit system which uses the unused hydraulic pump P3 as a pressure oil source for the accelerating operation thereof without an additional hydraulic pump or hydraulic circuit.

Figure 5:
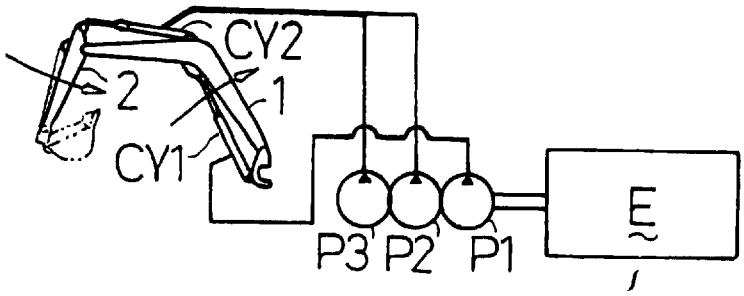
FIG. 5 is a similar diagram during the simultaneous driving of the boom and the arm.

In the same construction which supplies pressure oil as the above during the individual driving of the hydraulic actuators, the cases of simultaneous driving of more than one of the hydraulic actuators will be described in accordance with FIGS. 5 through 8. At first, during the simultaneous driving of the boom 1 and arm 2 as shown in FIG. 5, while the boom cylinder CY1 is supplied with the pressure oil from the first pump P1, and the arm cylinder CY2 from the second pump P2, there is such a problem that which cylinder CY1 or CY2 is additionally supplied with the pressure oil from the unused third pump 3. The simultaneous driving of the boom 1 and arm 2 is required when the working arms are folded. In this situation, the foremost desired operation is that the arm 2, which has been expanded apart from the main body 4, is pulled swiftly into a safe range, so that priority should be given to the operation of the arm 2. Accordingly, the pressure oil from the third pump P3 is joined to the hydraulic circuit from the second pump P2 to the arm cylinder CY2 for supplying the arm cylinder CY2 with the joined pressure oil, thereby accelerating the arm 2.

Figure 6:
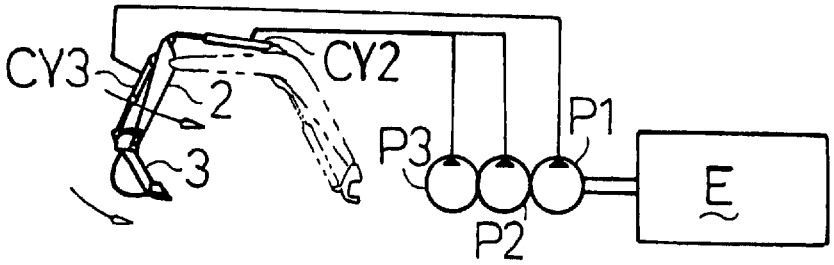
FIG. 6 is a similar diagram during the simultaneous driving of the arm and the bucket.

As shown in FIG. 6, during the simultaneous driving of the arm 2 and bucket 3, the bucket cylinder CY3 is supplied with pressure oil from the first pump P1, and the arm cylinder CY2 is supplied with joined pressure oil from the second pump P2 and the third pump P3 in consideration that the operating range of the arm 2 is larger than that of the bucket 3, thereby accelerating the arm 2.

When the main body 4 is turned during the simultaneous driving of the boom 1 and arm 2, the third pump P3 supplies pressure oil into the turning motor M, which is an original object to be supplied by the third pump P3. In other words, the pressure oil is supplied from the first pump P1 to the boom cylinder CY1, from the second pump P2 to the arm cylinder CY2, and from the third pump P3 to the turning motor M, respectively.

Figure 8:
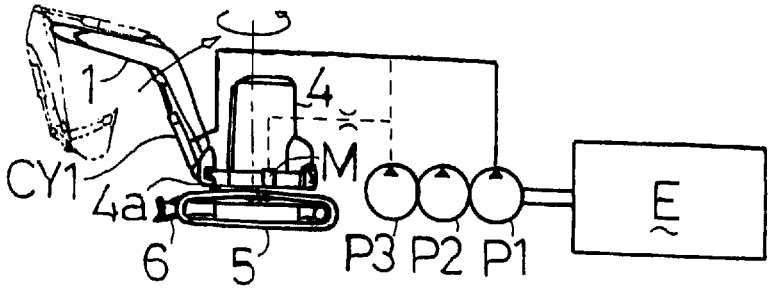
FIG. 8 is a similar diagram during the simultaneous driving of the boom and the turning main body.

During the simultaneous driving of the boom 1 and turning of the main body 4, a slow turning of the main body 4 is allowed or preferred, and the boom 1 is desired to be erected as soon as possible. Then, as shown in FIG. 8, the hydraulic circuit between the third pump P3 and the turning motor M is throttled and branches toward the boom cylinder CY1 so as to join the pressure oil from the third pump P3 with the original pressure oil flow from the first pump P1 to the boom cylinder CY1. Due to the addition of the slight pressure oil from the third pump P3 to that for the boom cylinder CY1, the acting speed of the boom 1 is increased so much. The turning speed of the main body 4 is reduced because of the throttling of the pressure oil flow for the turning motor M.

Next, explanation will be given on the hydraulic circuit system shown in FIG. 9, which makes the above mentioned various patterns of pressure oil supplying to the hydraulic actuators (the hydraulic cylinders CY1 through CY3 and turning motor M) for driving the working arms (the boom 1, arm 2 and bucket.3) and for turning the main body 4. In this regard, it is assumed that each of hydraulic valves V1 through V8 is neutral and not a pilot pressure Pa for accelerating the boom 1 but a pilot pressure Pb is applied onto a hydraulic accelerating valve V.

A hydraulic left travelling valve V5L is supplied with the pressure oil from the first pump P1 for driving the left travelling motor ML, and a hydraulic right travelling valve V5R from the second pump P2 for driving the right travelling motor MR. The pressure oil from the first pump P1 passing the left travelling valve V5L is supplied to a hydraulic boom valve V1 for controlling the boom cylinder CY1, and further to a hydraulic bucket valve V3 for controlling the bucket cylinder CY3. The pressure oil from the second pump P2 passing the right travelling valve V5R is supplied to a hydraulic arm valve V2 for controlling the arm cylinder CY2 through a hydraulic swinging valve V7 for controlling the lateral rotation of the boom bracket 4*a* supporting the basic end of the boom 1, and a hydraulic PTO valve V8. The pressure oil from the third pump P3 is supplied to a hydraulic turning valve V4 through a hydraulic blade valve V6 for controlling the hydraulic cylinder for vertical motion of the blade 6, and the accelerating valve V.

From the accelerating valve V is extended a boom accelerating circuit R1 to the boom valve V1, and a throttling circuit R2 to the turning valve V4. When the pilot pressure Pa is applied onto the accelerating valve V, the pressure oil from the third pump P3 passing the accelerating valve V (through the blade valve V6) is divided into the boom accelerating circuit R1 and the throttling circuit R2. The boom accelerating circuit R1 joins the hydraulic circuit to the boom cylinder CY1. The throttling circuit V4 joins the hydraulic circuit to the turning motor M. Unless the main body 4 is turned, the turning valve R2 is neutral, so that the hydraulic circuit to the boom cylinder CY1 is supplied with the formal quantity of pressure oil from the third pump P3 through the boom accelerating circuit R1 without flowing to the turning valve V4 through the throttling circuit R2, thereby accelerating the boom 1, or making the condition shown in FIG. 1.

When the boom 1 is driven and the main body 4 is turned simultaneously, the turning valve V4 is supplied with the reduced pressure oil through the throttling circuit R2, thereby turning the main body 4 slowly. The remaining pressure oil from the third pump P3 flows into the boom accelerating circuit R1. This condition is shown in FIG. 8.

The pilot pressure Pa is applied only when the boom 1 is accelerated during the individual driving of the boom 1 or during the simultaneous driving of the boom 1 and the main body 4. At all other times, the pilot pressure Pa is not applied so that the pressure oil from the third pump P3 does not flow into either the boom accelerating circuit R1 or the throttling circuit R2. In case of driving the boom cylinder CY1 together with another hydraulic driving means as shown in FIG. 5 or 7, the boom cylinder CY1 is supplied with only the pressure oil from the first pump P1.

During the simultaneous driving of the boom 1 and arm 2 as shown in FIG. 5 in the condition that not the pilot pressure Pa but the pilot pressure Pb is applied onto the accelerating valve V, the acceleration of the arm 2 is prior to that of the boom 1, so that the pressure oil from the third pump P3 through the accelerating valve V passes the neutral turning valve V4 and an arm accelerating circuit R3 joining the hydraulic circuit between the second pump P2 and the arm valve V2, whereby the arm cylinder CY2 is supplied with the joined pressure oil, thereby accelerating the arm 2. Additionally, a PTO accelerating circuit R4 is interposed between the arm accelerating circuit R3 and the PTO valve V8. Unless the arm 2 is driven(when the arm valve V2 is in neutral), the pressure oil through the arm accelerating circuit R3 flows into the PTO accelerating circuit R4, thereby enabling a PTO driving device to be driven.

Figure 7:
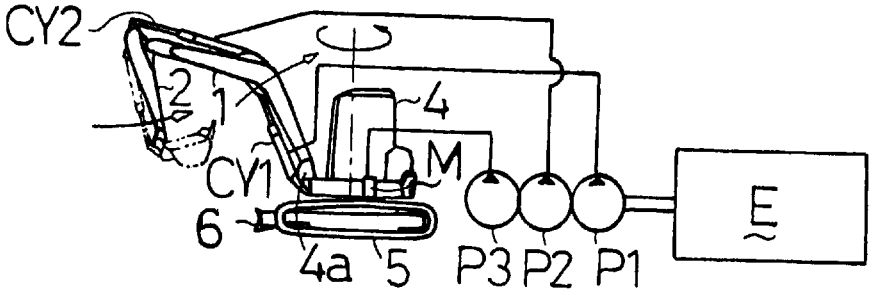
FIG. 7 is a similar diagram during the simultaneous driving of the boom, the arm and the turning main body.

As shown in FIG. 7, when the main body 4 is rotated simultaneously with the driving of the boom 1 and arm 2, the turning valve V4 is set in the acting position, thereby shutting off the pressure oil flow to the arm accelerating circuit R3. Thus, the arm cylinder CY2 is supplied with only the pressure oil from the second pump P2, so that the arm 2 is driven without being accelerated.

Figure 9:
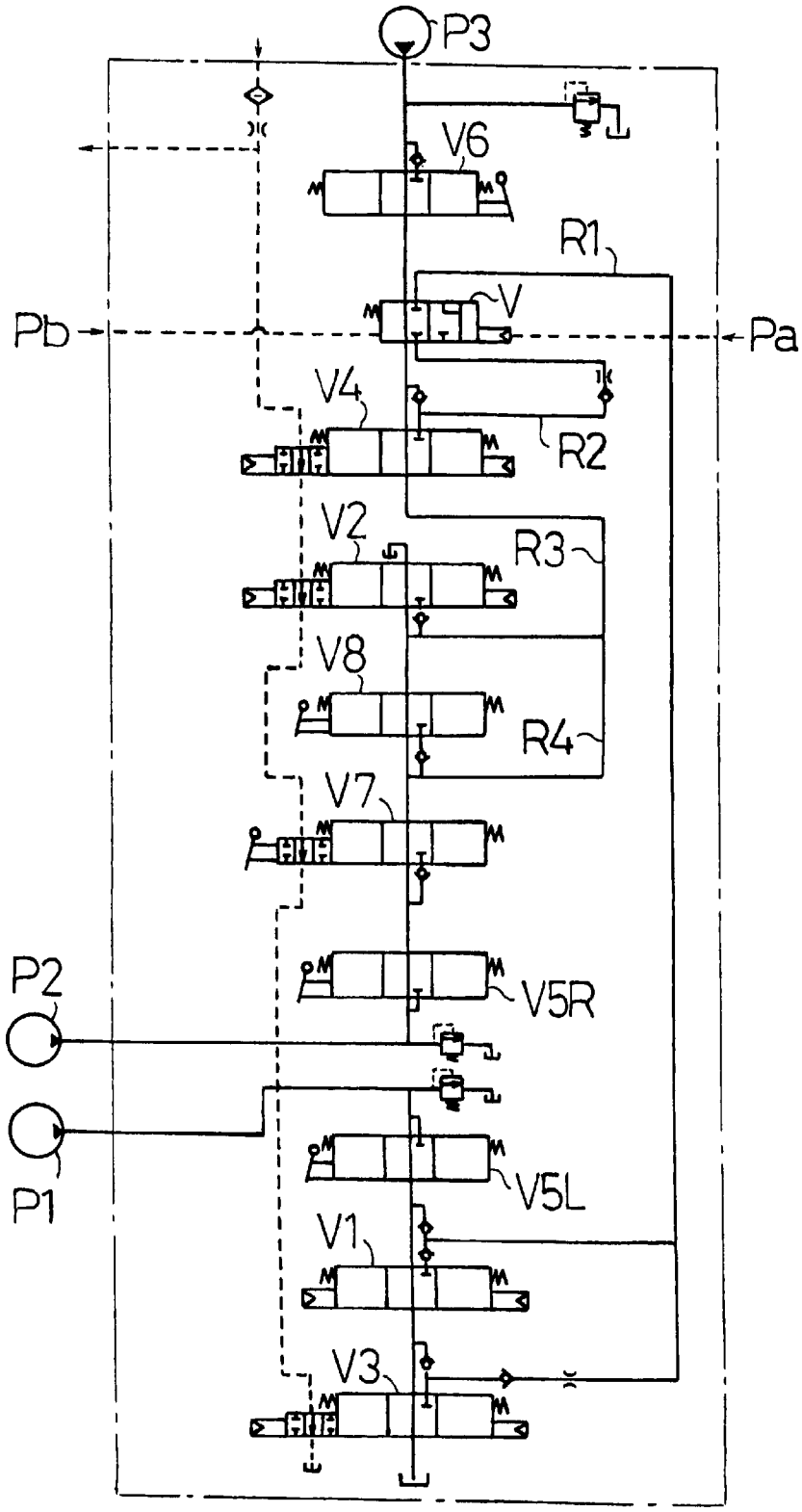
FIG. 9 is a hydraulic circuit diagram of the turning excavator for making the pressure oil supplying patterns shown in FIGS. 1 through 8.

The hydraulic circuit system shown in FIG. 9 such constructed as the above mentioned can make every hydraulic driving pattern of them shown in FIGS. 1 through 8. However, a small excavator employing the system occasionally requires no acceleration or requires the reduction of the increased operation speed. The hydraulic circuit system shown in FIG. 10 answers to such requirements. In this case, the boom accelerating circuit R1 extended from the accelerating circuit V can constitute a bleed-off-circuit R1' without joining the hydraulic circuit between the first pump P1 and the boom valve V1, so that the boom 1 is not accelerated, thereby preventing the erecting of the boom 1 from being badly operated at excessive high speed.

The hydraulic circuit shown in FIG. 10 also limits the increasing speed of the arm 2. In this regard, the arm accelerating circuit R3, through which the pressure oil from the third pump P3 flows, branches so as to constitute a cut-off circuit R3a having an orifice toward a bleed-off (draining) circuit R5 extended from the arm valve V2. Accordingly, a part of the pressure oil from the third pump P3 flows into the bleed-off circuit R5 through the cut-off circuit R3a, thereby being bled off. The remaining discharged pressure oil therefrom enters the arm accelerating circuit R3, so that the arm cylinder CY2 is supplied with pressure oil less than that in the case shown in FIG. 9. Thus, the increasing speed of the arm 2 is limited so as to prevent the arm 2 from being badly operated at excessive high speed. Additionally, when the hydraulic circuit for PTO as shown in FIG. 9 is provided in the hydraulic circuit shown in FIG. 10, the whole of pressure oil toward the arm accelerating circuit R3 flows through the PTO accelerating circuit R4. Thus, the providing of the cut-off circuit R3a enables the the increasing of the PTO operation speed to be limited.

The hydraulic circuit system for a turning excavator such constructed as the above according to the present invention is advantageous as follows:

The above various pressure oil supplying patterns are made by the first and second main pumps P1 and P2 and the third pump P3 without another additional hydraulic pump for acceleration. Particularly, during the individual driving of the hydraulic actuator for the boom or arm, the pressure oil for acceleration thereof can be supplied from the third pump P3, which is not used for turning of the main body, so that the boom or arm can be operated at an increased speed by such simple and low-costing system, thereby improving the efficiency of working.

When the system is provided with a plurality of the third pumps P3, the pressure oil for acceleration of the individual driving of the boom or arm can be increased, thereby driving it more swiftly.

Referring to the simultaneous driving of the boom and arm, since the operation speed of the arm is higher than that of the boom because of the preferential supplying of the hydraulic actuator for the arm with pressure oil from the third pump P3, the horizontally excavating motion of the bucket, for example, can be swift and smooth, and when folding the working arms, the arm expanded apart from the main body can be pulled swiftly so as to be firstly placed in the safe range of the excavator.

Referring to the simultaneous driving of the bucket and arm, since the operation speed of the arm is higher than that of the bucket because of the preferential supplying of the hydraulic actuator for the arm with pressure oil from the third pump P3, the arm can be pulled swiftly into the safe range when the arm and bucket are folded toward the arm or in other cases.

Referring to the simultaneous driving of the boom and turning of the main body, the turning speed of the main body is limited while the operation speed of the boom is increased because of the actuator for the boom additionally supplied with a part of pressure oil flowing between the third pump P3 and the actuator for the main body, so that, when the excavator raises sand and move it to a truck, the erecting motion of the boom is relatively faster than the turning speed of the main body, whereby the excavator can do it swiftly and smoothly.

On the precondition that the branching circuit to the hydraulic actuator for the boom can communicate with the draining circuit, if the acceleration of the boom is unnecessary in such a case that the hydraulic system is applied on a small turning excavator or so on, the branching circuit is made to be a bleed-off-circuit, so that the actuator for the boom is always supplied with only pressure oil from the first pump P1 without additional pressure oil from the third pump P3, thereby preventing the boom from being badly operated too fast. It means that the hydraulic circuit system can be applied on either of small and large excavators, thereby reducing the manufacturing cost thereof.

Additionally, on the precondition that a part of pressure oil between the third pump P3 and the hydraulic actuator for the arm is introduced into the draining circuit, even if the acceleration of the arm is not necessary so much, the amount of pressure oil from the third pump P3 to the actuator for the arm is limited because of the partly bleeding-off of pressure oil between the third pump P3 and the actuator for the arm is bled off, so that the increased operation speed of the arm is limited, thereby preventing the arm from being badly operated too fast. It means that the hydraulic circuit system can be applied on either of small and large excavators, thereby reducing the manufacturing cost thereof.

Field of Industrial Use

The hydraulic circuit system of the present invention is suitable to a turning excavator having respective hydraulic actuators for driving working arms and turning a main body, the hydraulic actuators being supplied with pressure oil from at least three hydraulic pumps, which has the capacity of accelerating a boom or an arm for improving efficiency of works.

What is claimed is:

1. A hydraulic circuit system for a turning excavator, comprising:

a first hydraulic pump and a second hydraulic pump, wherein one of said first and second hydraulic pumps is fluidly connected to a first hydraulic circuit that supplies pressure oil for driving a boom; and at least one hydraulic third pump for supplying pressure oil fluidly connected to a second hydraulic circuit for turning an excavator body, wherein, while said boom is driven and said excavator body is turned simultaneously, said at least one hydraulic third pump is also fluidly connected to said first hydraulic circuit so as to additionally provide a part of the pressure oil supplied for turning said excavator body to said first hydraulic circuit, thereby accelerating operation of said boom.

2. The hydraulic circuit system for a turning excavator as set forth in claim 1, further comprising:

a branching circuit extended from said second hydraulic circuit, wherein, while said boom is driven and said excavator body is turned simultaneously, said branching circuit is fluidly connected to said first hydraulic circuit so as to additionally supply a part of the pressure oil supplied for turning said excavator body to said first hydraulic circuit, thereby accelerating operation of said boom; and a draining circuit fluidly connected to said branching circuit, wherein a part of the pressure oil through said branching circuit is introduced into said draining circuit.

3. The hydraulic circuit system for a turning excavator as set forth in claim 2, further comprising:

a PTO hydraulic circuit fluidly connected to said branching circuit for supplying pressure oil for driving a PTO device, wherein a part of the pressure oil through said PTO hydraulic circuit is introduced into said draining circuit.

4. A hydraulic circuit system for a turning excavator, comprising:

a first hydraulic pump for supplying pressure oil fluidly connected to a first hydraulic circuit for driving a boom;

a second hydraulic pump for supplying pressure oil fluidly connected to a second hydraulic circuit for driving an arm; and a hydraulic third pump for supplying pressure oil fluidly connected to a third hydraulic circuit for turning an excavator body, wherein said hydraulic third pump is also selectively fluidly connected to one of said first and second hydraulic circuits for providing additional pressure oil to said one of said first and second hydraulic circuits to accelerate operation of one of said boom and said arm.

5. A hydraulic circuit system for a turning excavator, comprising:

a first hydraulic pump for supplying pressure oil fluidly connected to a first hydraulic circuit for driving a boom;

a second hydraulic pump for supplying pressure oil fluidly connected to a second hydraulic circuit for driving an arm; and a plurality of hydraulic third pumps for supplying pressure oil, wherein at least one of said hydraulic third pumps is fluidly connected to a third hydraulic circuit for turning an excavator body, and wherein said plurality of hydraulic third pumps are also selectively fluidly connected to one of said first and second hydraulic circuits for providing additional pressure oil to said one of said first and second hydraulic circuits to accelerate operation of one of said boom and said arm.

6. A hydraulic circuit system for a turning excavator, comprising:

a first hydraulic pump for supplying pressure oil fluidly connected to a first hydraulic circuit for driving a boom;

a second hydraulic pump for supplying pressure oil fluidly connected to a second hydraulic circuit for driving an arm; and at least one hydraulic third pump for supplying pressure oil fluidly connected to a third hydraulic circuit for turning an excavator body, wherein, unless said excavator body is turned, said at least one hydraulic third pump is selectively fluidly connected to one of said first and second hydraulic circuits for providing additional pressure oil to said one of said first and second hydraulic circuits to accelerate operation of one of said boom and said arm, and wherein said hydraulic third pump is fluidly connected to said second hydraulic circuit to preferentially accelerate operation of said arm during the simultaneous driving of said boom, and said arm without turning said excavator body.

7. The hydraulic circuit system for a turning excavator as set forth in claim 6, further comprising:

a branching circuit extended from said third hydraulic circuit and selectively fluidly connected to one of said first and second hydraulic circuits for accelerating one of said boom and said arm, wherein said branching circuit is fluidly connected to said second hydraulic circuit to preferentially accelerate operation of said arm during the simultaneous driving of said boom and said arm without turning said excavator body; and a draining circuit fluidly connected to said branching circuit, wherein a part of the pressure oil through said branching circuit is introduced into said draining circuit.

8. A hydraulic circuit system for a turning excavator, comprising:

a first hydraulic pump for supplying pressure oil fluidly connected to a first hydraulic circuit for driving a boom and a bucket;

a second hydraulic pump for supplying pressure oil fluidly connected to a second hydraulic circuit for driving an arm; and at least one hydraulic third pump for supplying pressure oil fluidly connected to a third hydraulic circuit for turning an excavator body, wherein, unless said excavator body is turned, said at least one hydraulic third pump is selectively fluidly connected to one of said first and second hydraulic circuits for providing additional pressure oil to said one of said first and second hydraulic circuits to accelerate operation of one of said boom and said arm, and wherein said hydraulic third pump is fluidly connected to said second hydraulic circuit for preferentially accelerating said arm during the simultaneous driving of said arm and said bucket without turning said excavator body.

* * * * *